US006293347B1

(12) United States Patent
Cahill

(10) Patent No.: US 6,293,347 B1
(45) Date of Patent: Sep. 25, 2001

(54) SLEEVE AND METHOD OF USE FOR PREVENTING POLISH ROD SCORING BY A PUMP JACK CARRIER STRUCTURE

(75) Inventor: Drew E. Cahill, Keoma (CA)

(73) Assignee: Hugh A. Williamson, Calgary (CA); a part interest ( * ) Notice: Subject to any disclaimer, the term of this patent is extended or adjusted under 35 U.S.C. 154(b) by 0 days.

(21) Appl. No.: 09/386,216

(22) Filed: Aug. 31, 1999

(30) Foreign Application Priority Data

Sep. 1, 1998 (CA) ..... 2246196

(51) Int. Cl.[7] ..... E21B 19/00; E21B 33/03

(52) U.S. Cl. ..... 166/379; 166/85.5; 166/241.1; 166/105; 166/68

(58) Field of Search ..... 166/68, 69, 78.1, 166/84.1, 85.5, 105, 241.1, 379

(56) References Cited

U.S. PATENT DOCUMENTS

| | | | | |
|---|---|---|---|---|
| D. 362,196 | | 9/1995 | Angelo et al. . | |
| 4,515,220 | * | 5/1985 | Sizer et al. | 166/384 |
| 4,947,936 | | 8/1990 | Ellwood . | |
| 5,058,668 | * | 10/1991 | Newton | 166/84.1 |
| 5,143,153 | * | 9/1992 | Bach et al. | 166/68.5 |
| 5,549,158 | | 8/1996 | Hart . | |
| 5,567,138 | | 10/1996 | Newton . | |
| 6,000,469 | * | 12/1999 | Bassinger | 166/84.1 |

OTHER PUBLICATIONS

Flow Control Equipment, Hercules Rod Rotators, Brochure dated 1997.

* cited by examiner

*Primary Examiner*—David Bagnell
*Assistant Examiner*—Jennifer R. Dougherty
(74) *Attorney, Agent, or Firm*—Sean W. Goodwin

(57) ABSTRACT

Apparatus and method are provided for protecting a reciprocating polish rod from suffering circumferential scoring when it is rotated by a rod-rotator while misaligned and in contact with the carrier bar of a pump jack. A cylindrical sleeve is inserted through the bore of the carrier bar and any additional stacked components supported thereon. An upset at the top of the sleeve retains it within the bore of the carrier bar and any stacked components. The bottom end of the sleeve extends substantially to the bottom of the carrier bar. The polish rod is installed through the bore in the sleeve and can slide and rotate therein. The polish rod is suspended from the carrier structure with a rod clamp. The sleeve guides the polish rod through the carrier structure without permitting accidental contact of the polish rod and the carrier structure and thereby prevents circumferential scoring of the polish rod when the rod is rotated by the rod-rotator.

8 Claims, 6 Drawing Sheets

SLEEVE AND METHOD OF USE FOR PREVENTING POLISH ROD SCORING BY A PUMP JACK CARRIER STRUCTURE

FIELD OF THE INVENTION

The invention relates to a device for protecting a polish rod from circumferential scoring which damages the rod adjacent the carrier bar of a pump jack. The scoring is associated with the use of rod-rotators applied to for reciprocating sucker rods.

BACKGROUND OF THE INVENTION

Beam pumping units or pump jacks are known for driving reciprocating pumps located downhole in the bore of a subterranean oil well. A string of sucker rods is suspended from the carrier bar of the pump jack. A polish rod at the top of the string of sucker rods connects to the carrier bar and extends downwardly through a stuffing box seal at a wellhead. The polish rod connects to the string of sucker rods extending downhole to the pump.

In operation, the reciprocating rods tend to rub against the inside of the production tubing, causing wear to the rods, rod couplings, and tubing. This occurs particularly in the cases of slanted wells where the rods tend to rest on the lower side of tubing. To limit or distribute the inevitable wear, a rod-rotator is used to incrementally rotate the polish rod each pump stroke.

The polish rod is suspended by a polish rod clamp atop the carrier bar or rod-rotator. The carrier bar is suspended from the horsehead of the pump jack by a cable bridle. The polish rod extends through the carrier bar. Misalignment of the polish rod and the carrier bar can result in contact of the carrier bar and polish rod. A rod-rotator is in turn supported by the carrier bar. Subsequent rotation of the polish rod results in circumferential scoring a the interface of the carrier bar and the polish rod.

Examples of misalignment between the carrier bar and the polish rod include:

- mechanical misalignment of the carrier bar;
- a slow or restricted downstroke and a resultant slackening of the cable bridle causing angular movement of the carrier bar; and
- a misaligned polish rod extending from the wellhead seal.

The polish rod is expected to carry high cyclical loading so as to support rod string loads on the upstroke of about 13,000–40,000 pounds. If a polish rod were to fail at a stress riser, such as at a circumferential score, the rod string could fall into the well, potentially releasing well fluid (oil or gases) from the stuffing box seal and initiating an expensive recovery operation.

Preventative maintenance regularly calls for replacement of scored polish rods before they fail. Replacement polish rods can cost $700 to $1200 each. As stated above, polish rod failure can result in the escape of oil and gas and force an expensive cleanup and rod recovery process.

An example of a rod-rotator is the Hercules (registered trademark) Rod Rotator available from Flow Control Equipment, Borger, Tex. The Hercules Rod Rotator sits atop a leveling plate which in turn sits atop the carrier bar. Hercules specifies an aluminum pilot bushing which fits between the leveling plate and the rotator. The bushing comprises a ring with a short depending portion to mate with and center the bushing in the leveling plate. The polish rod extends therethrough and is centered relative to the rod-rotator and the leveling plate. The prior art bushing does not fix the relationship between the polish rod and carrier bar.

The polish rod is still subject to misalignment and wear as it extends from the bottom of a misaligned carrier bar.

Accordingly, there is a need for a way to protect a rotating polish rod from circumferential scoring regardless of the positioning or style of the rod-rotator.

SUMMARY OF THE INVENTION

Novel apparatus is provided which protects the polish rod from circumferential scoring caused by misalignment of the carrier structure and subsequent rotation of the polish rod. In a conventional pump jack, a rod-rotator is centralized and connected to the polish rod. The polish rod extends through a bore extending throughout the carrier structure, the structure including the carrier bar suspended from the pump jack, and other stacked components supported by the carrier bar. The carrier bar and other stacked components of the carrier structure are not centralized and thus can contact and damage the polish rod if misaligned.

In a broad apparatus aspect of the invention, a cylindrical sleeve is inserted into the bore of the carrier structure. The sleeve has a bore through which the polish rod can pass, both slidably and rotatably. The top end of the sleeve has an upset for retaining the sleeve within the bore of the carrier structure. The bottom end of the sleeve extends substantially to the bottom of the carrier structure. In a preferred embodiment, the carrier structure comprises only a carrier bar and thus the length of the sleeve is substantially equal to the height of the bore through the carrier bar. With additional stacked components, like a dynamometer, the length of the sleeve is substantially equal to the height of the bore through both the stacked components including the dynamometer and the carrier bar.

In a broad method aspect, a method is provided for protecting a polish rod from circumferential scoring, the polish rod being reciprocated by a pump jack by:

- providing a cylindrical sleeve having a bore therethrough and an upset at one end;
- installing the sleeve into the top of the bore extending through the carrier structure, retained therein by the sleeves upset;
- installing the polish rod through the bore of the sleeve; and
- suspending the polish rod from the top of the carrier structure so that the sleeve guides the polish rod through the carrier structure without contact of the polish rod and the carrier structure and thereby preventing circumferential scoring of the polish rod when the rod is rotated by the rod-rotator.

DETAILED DESCRIPTION OF THE PREFERRED EMBODIMENT

Figure 1:
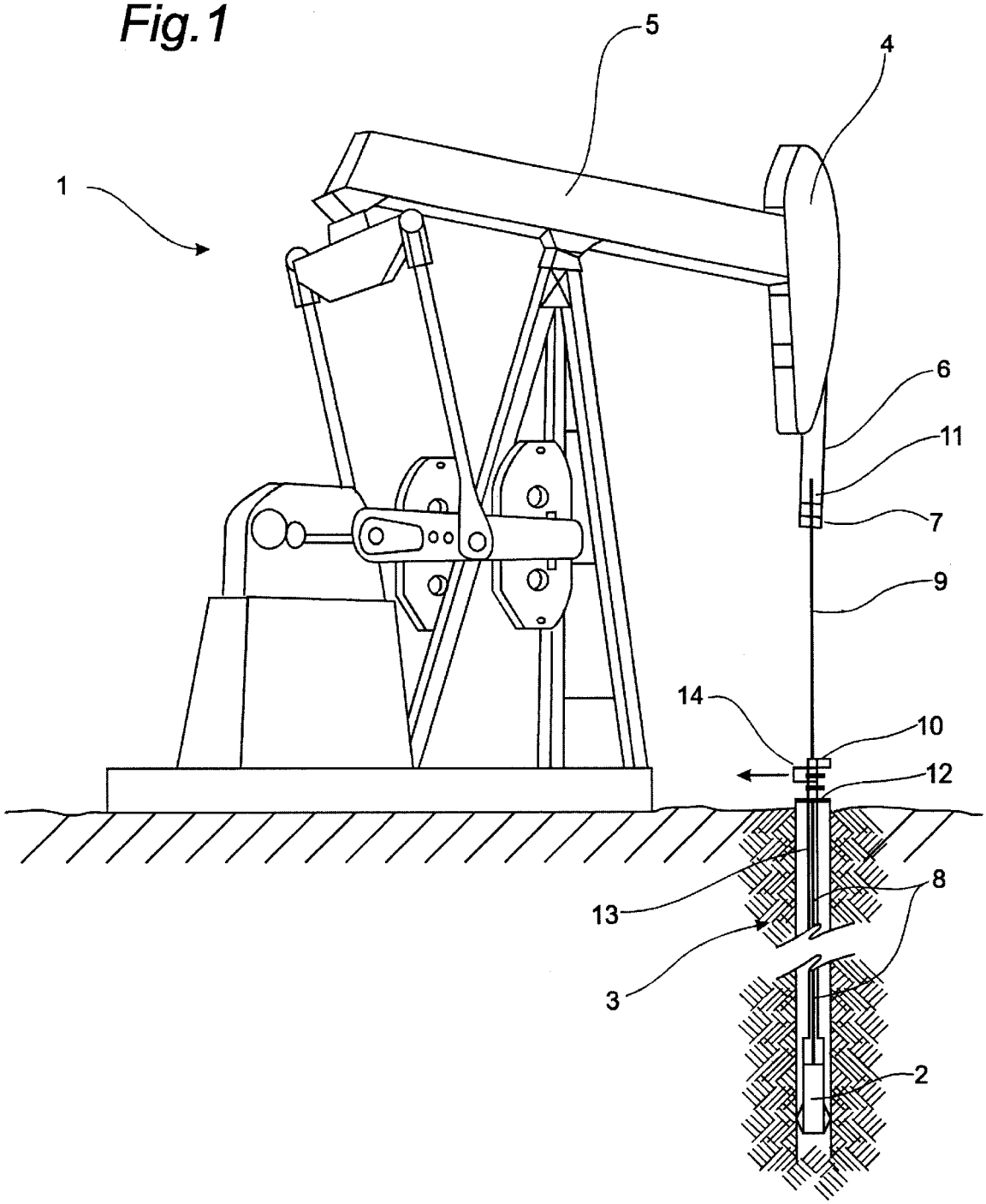
FIG. 1 is perspective view of a conventional pump jack for reciprocating the rod string of a downhole pump.

Having reference to FIG. 1, a conventional beam pumping unit 1 is shown driving a reciprocating pump 2 located downhole in the bore of a subterranean oil well 3. A horsehead 4, located at one end of a walking beam 5, delivers the reciprocal pumping stroke to the pump 2. A cable bridle 6 is suspended from cables 6*a*,6*b* which roll tangentially over the horsehead 4 as it reciprocates. A carrier bar 7 is hung from the end of the reciprocating cable bridle 6. A string of sucker rods 8 is suspended from the carrier bar 7. The rod string 8 extends down production tubing 13 to drive the subterranean pump 2.

A polish rod 9 is connected to the top of the rod string 8. The polish rod 9 extends upwardly through a stuffing box seal 10 and through a bore 23 in the carrier bar 7. A rod clamp 11 is secured to the polish rod 9 above the carrier bar 7. The weight of the polish rod 9 is borne by the rod clamp 11, which bears against the carrier bar 7.

The seal 11 is located atop wellhead 12 at the ground's surface. When the polish rod and rod string 9,8 are reciprocated up and down, fluids are pumped up the production tubing 13 to the wellhead 12 and out of a flow tee 14 located below the seal 11.

Figure 2:
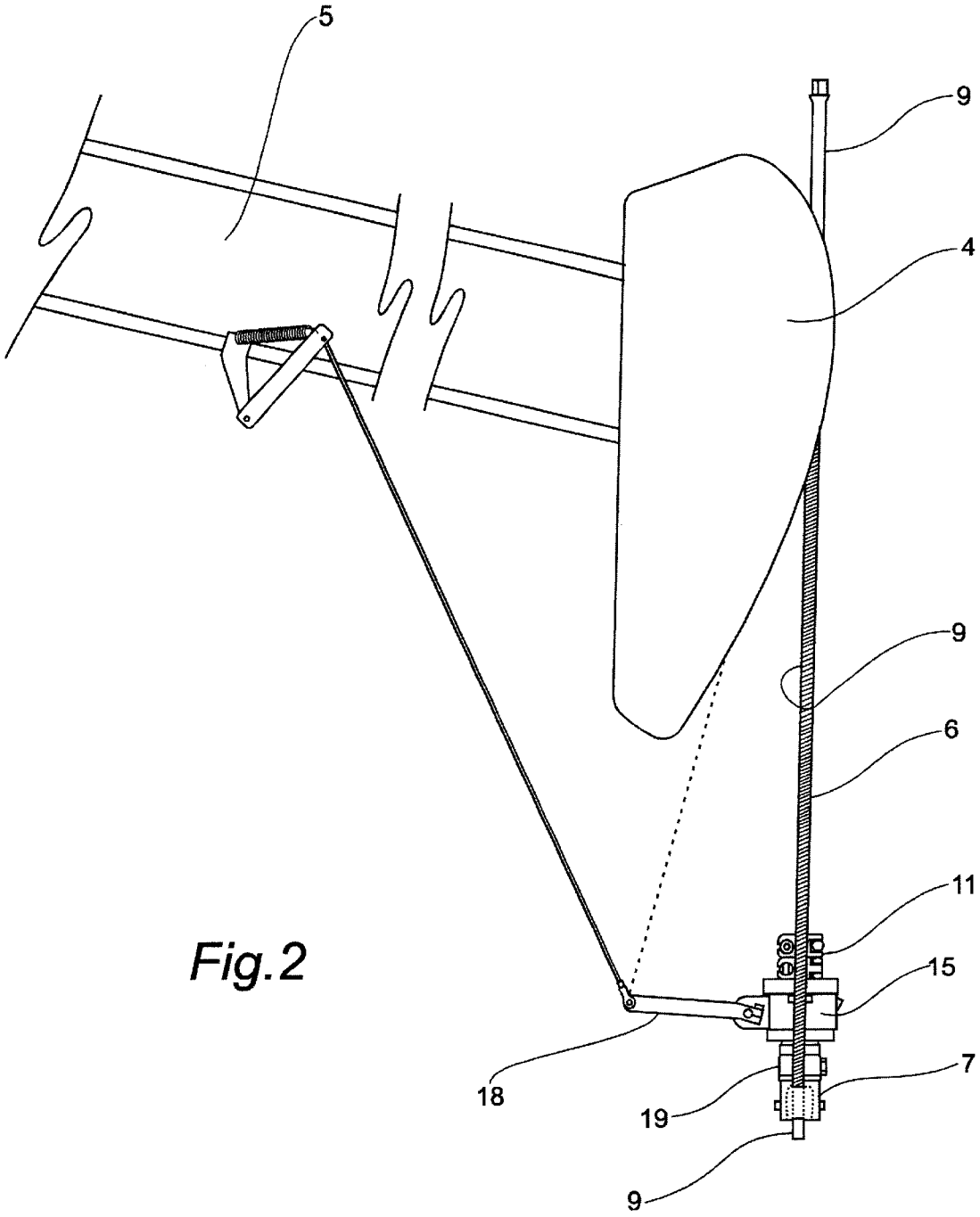
FIG. 2 is a partial close-up view of the horsehead, carrier bar and a rod-rotator for rotating the polish rod of the rod string.

As shown in FIG. 2, a rod-rotator 15 is shown in a typical location above the carrier bar 7. The polish rod 9 extends through the rod-rotator 15. Accordingly, the polish rod 9 is suspended by the rod-rotator 15 which in turn is supported by the carrier bar 7.

Figure 3:
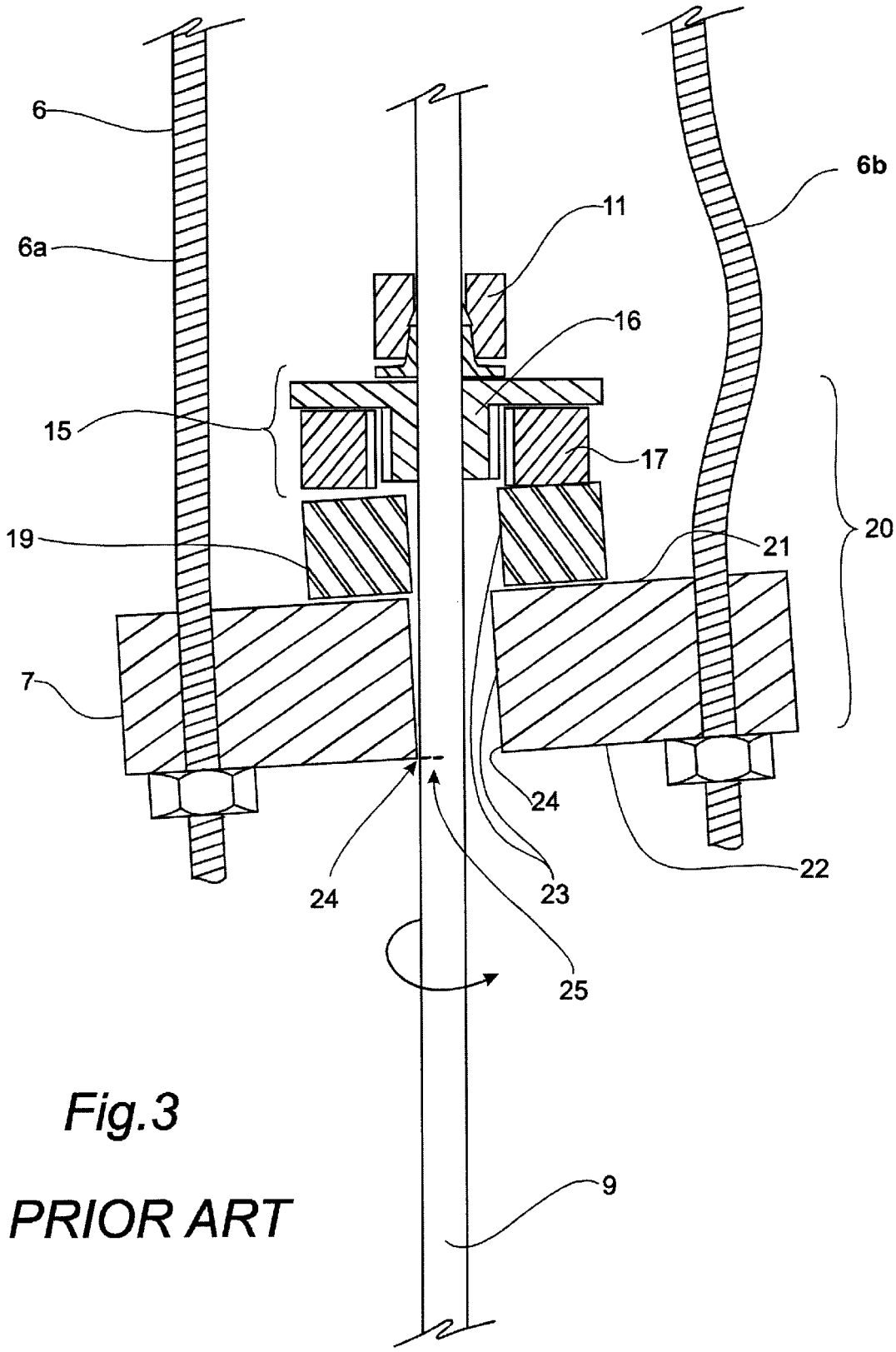
Fig.3 PRIOR ART
FIG. 3 is a cross-sectional view of the cable bridle and carrier structure of the prior art. The cable bridle is in a slack condition and the carrier bar is misaligned.

Rod-rotator apparatus are known in the art and are not fully detailed in the drawings. Referring also to FIG. 3, basically the rod-rotator 15 comprises an inner sleeve 16 which is clamped to the polish rod 9, and an outer sleeve 17 which is held against rotation relative to the carrier bar 7. A ratchet (not shown) incrementally rotates the inner sleeve 16 relative to the outer sleeve 17. The rod-rotator 15 uses a lever 18 and the cyclical change in the angle between the beam 5 and the polish rod 9 to actuate the rotating ratchet and induce polish rod rotation. Rod rotational rates are typically about 30 to 700 beam strokes per revolution.

As stated above, the polish rod 9 is suspended from the carrier bar 7 by the polish rod clamp 11. Reciprocation of the cable bridle 6 and carrier bar 7 causes the rod 9 to reciprocate up and down. Other components including a rod-rotator, a leveling plate (not shown), or a dynamometer 19 may also be installed on the carrier bar between the polish rod clamp 11 and the carrier bar 7.

All of the components 15, 19, 7 stacked between the polish rod clamp 11 and the bottom of the carrier bar 7 are referred to herein and collectively as the carrier structure 20. The carrier structure 20 forms a top end 21 which supports the rod clamp 11, and a bottom end 22 from which the polish rod 9 extends. The significance of the carrier structure 20 is that, for example, neither the dynamometer nor the carrier bar are clamped or centralized to the polish rod 9. Accordingly, relative movement can occur between the polish rod 9 and the individual components of the carrier structure.

Each component of the carrier structure 20 has a bore for passing the polish rod and thus the carrier structure 20 forms a contiguous bore 23 therethrough.

The polish rod 9 is expected to carry high cyclical loading, so to avoid failure, high turnaround cost and the associated potential for the release of well fluid, good practice requires the polish rod to be maintained in good, cyclical stress-resistant condition.

As shown in FIG. 3 (Prior Art), the cable bridle 6 is slack (possibly due to a slow pump plunger). One of the cables 6*b* is shown in a slack state and has deviated while the other taut cable 6*a* has not. As a result, the carrier bar 7 is twisted and an edge 24 of the bore 23 has contacted the polish rod. Typically, the carrier bar 7 is manufactured of a material capable of scoring the polish rod. Accordingly, if the rod rotator 15 is activated to rotate the polish rod 9, a circumferential score 25 can result.

Figure 4:
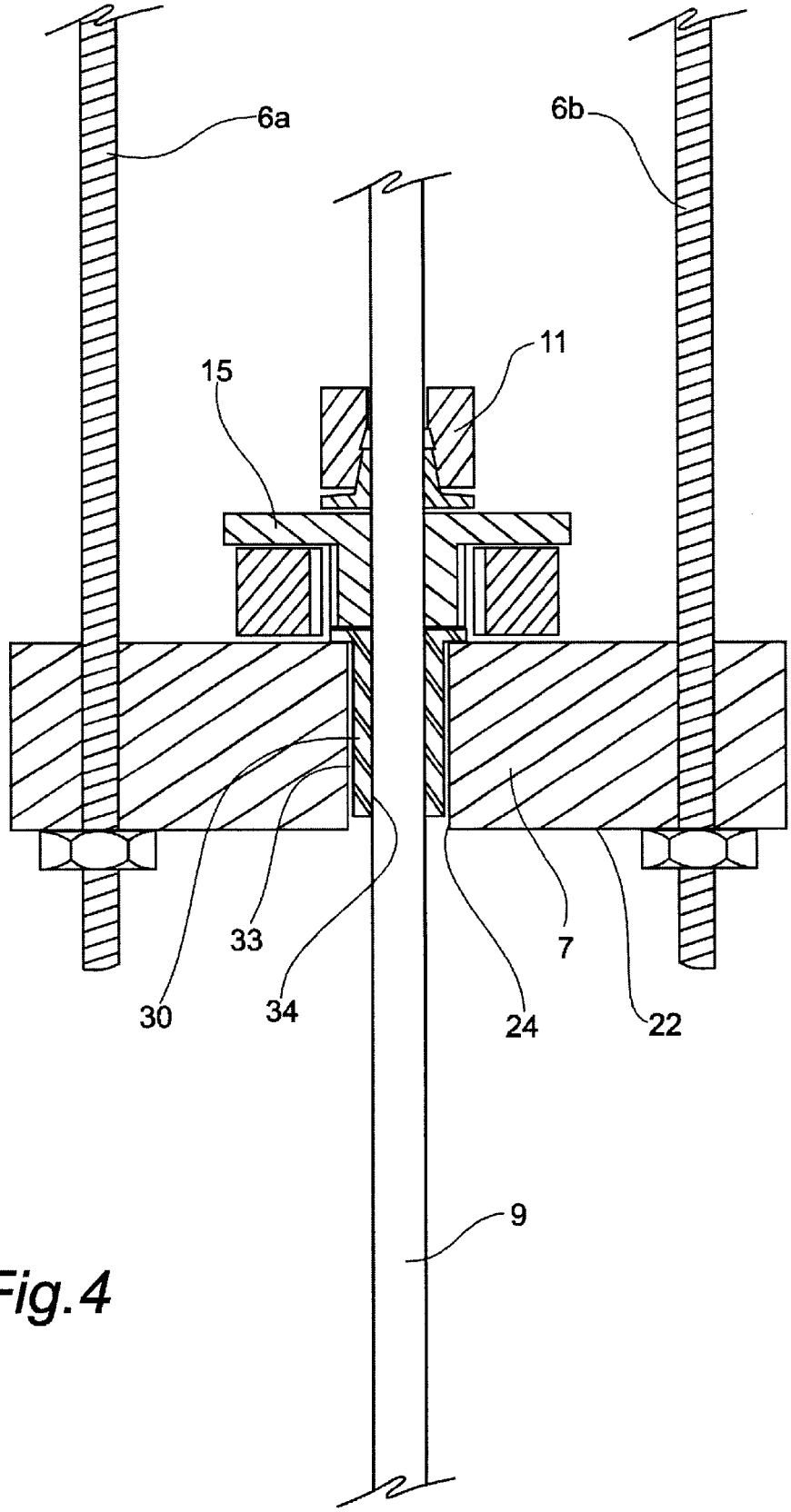
FIG. 4 is a partial cross-sectional view of the carrier structure with an embodiment of the sleeve of the invention installed within the carrier structure.
Figure 5:
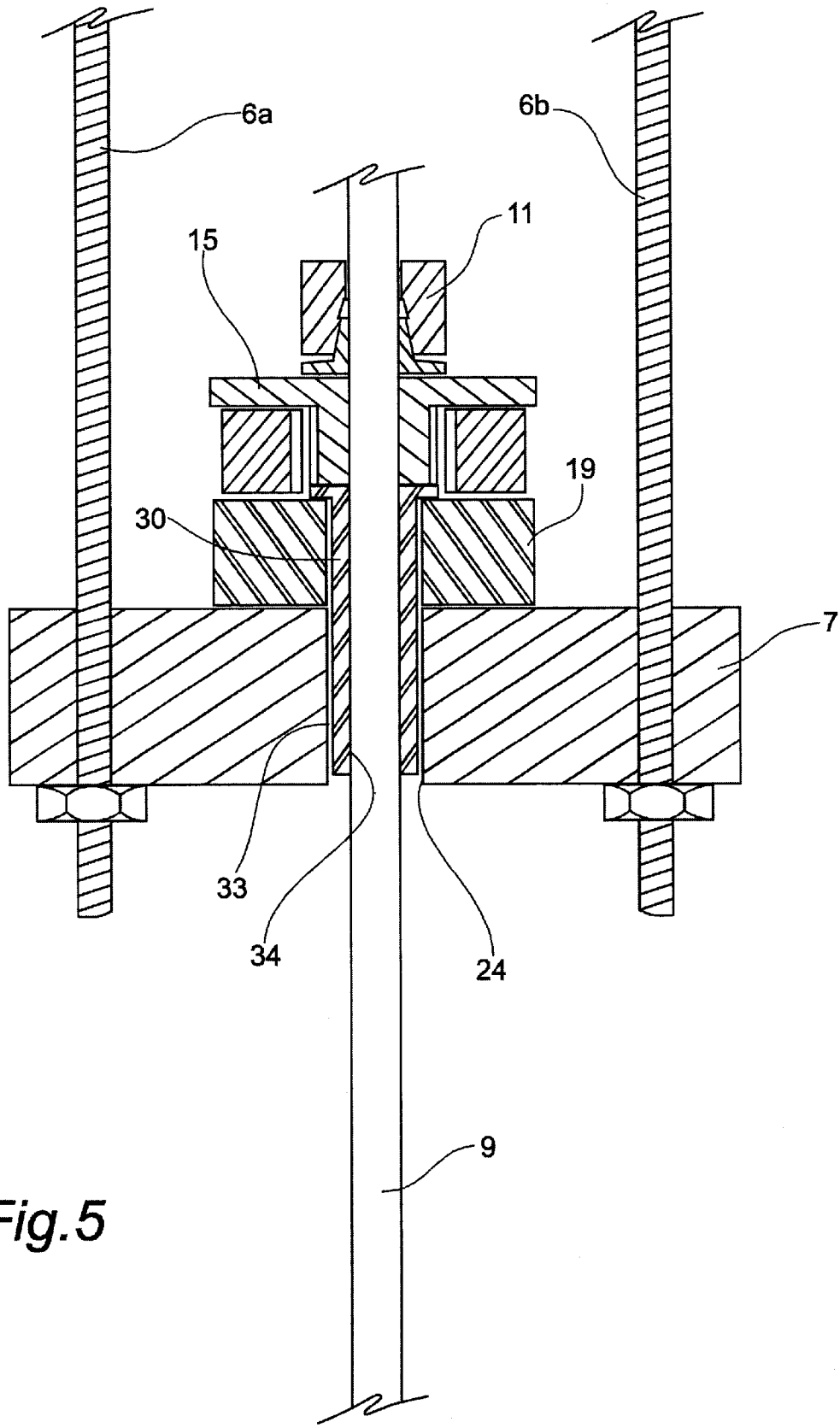
FIG. 5 is a partial cross-sectional view of the carrier structure with an embodiment of the sleeve of the invention installed therein where the structure includes an additional component.
Figure 6:
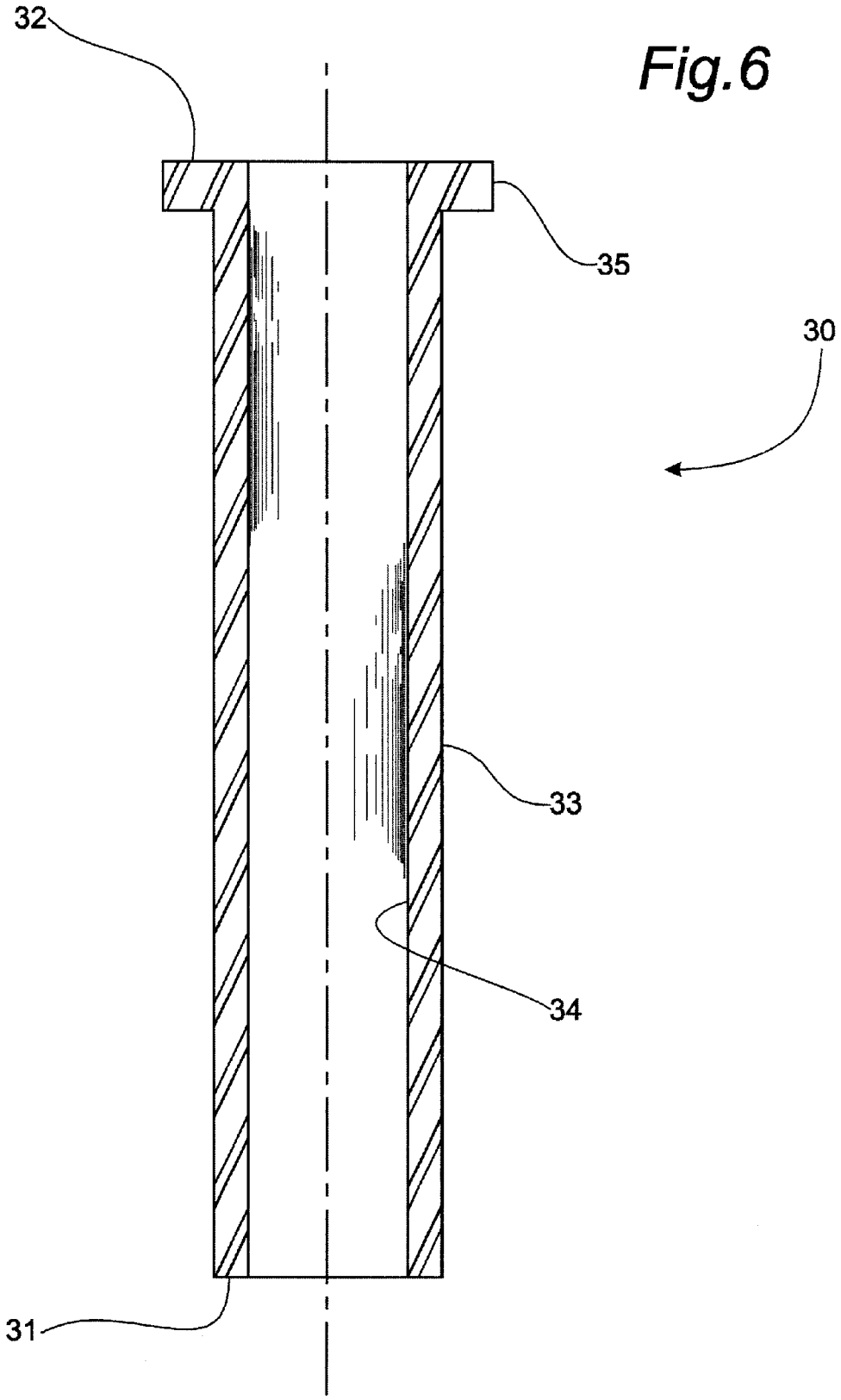
FIG. 6 is a cross-sectional view of the sleeve, manufactured in accordance with the present invention.

Turning to FIGS. 4 and 5, contact between the bottom of the carrier structure 20 and the polish rod 9 is prevented by employing a protective sleeve 30 manufactured according to the invention. In FIG. 5, note that the polish rod 9 must extend through a longer bore 23 if the carrier structure 20 comprises more than simply a carrier bar 7 as is shown in FIG. 4. As the length of the bore 23 through the carrier structure 20 lengthens (i.e. because of an added dynamometer 19, FIG. 5), the greater is the opportunity for a misalignment to result and cause scoring contact between the edge 24 and the polish rod 9.

The protective sleeve 30 is cylindrical and has top and bottom ends 32,31. The sleeve 30 has an outer diameter 33 adapted to slidably fit the bore 23 of the carrier structure 20 and has a bore 34 through which the polish rod 9 passes both slidably and rotatably.

The top end 32 of the sleeve 20 has a localized diameter increase or upset 35 which prevents the sleeve 30 from passing down through the bore 23 of the carrier structure 20.

The sleeve itself is manufactured of a material which is softer than the polish rod. A suitable material of manufacture is T66061 aluminum. the sleeve 20 is installed into the bore 23 of the carrier structure 20. The upset 35, at the top of the sleeve 30, retains the sleeve within the carrier structure 20.

The sleeve 30 need only extend through that part of the carrier structure 20 which is not centralized on the polish rod 9. In FIG. 4, without additional intervening components, the sleeve 30 need only centralize the carrier bar 7 (the rod-rotator is already centralized). In FIG. 5 the sleeve 30 must extend also through the dynamometer 19. The bottom end 31 of the sleeve 30 extends to a point substantially adjacent to the bottom of the carrier bar 7. Ideally the sleeve's bottom 21 terminates just short of extending through the bottom of the carrier bar 7. The sleeve 20 could also extend out the carrier bar's bottom end 22, but that would be an over-cautious implementation. In other words, the length of the sleeve 20 between the upset 35 and its bottom end 31 is substantially equal to the length of the non-centralized portion of the carrier structure 20 so that despite misalignment of the carrier structure and polish rod, the polish rod cannot come into relative contact.

When the polish rod 9 is installed through the bore 33 of the sleeve 30, the polish rod 9 cannot come into contact with any part of the carrier structure 20, particularly the edge 24 of the carrier bar 7, and thus prevents circumferential scoring of the polish rod 9 when it is rotated by the rod-rotator 15.

The embodiments of the invention in which an exclusive property or privilege is claimed are defined as follows:

1. Apparatus for preventing circumferential scoring of a reciprocating polish rod suspended by a carrier structure of a pump jack, the polish rod being rotated with a rod-rotator, the carrier structure comprising one or more stacked components including a top end for suspending the polish rod, a bore extending through the stacked components and through which the polish rod extends, and a bottom end from which the polish rod extends comprising:

a cylindrical sleeve having top and bottom ends, the sleeve having an outer dimension adapted to fit within the bore of the carrier structure and having a bore through which the polish rod passes slidably and rotatably; and an upset formed at the top end of the sleeve which extends radially and engages the stacked components for supporting the sleeve in the bore of the carrier structure and so that the bottom end of the sleeve extends substantially to the bottom end of the carrier structure, forms a bearing surface for supporting the rod-rotator, so that the sleeve guides the polish rod without contact of the polish rod and the carrier structure and thereby prevents circumferential scoring therebetween when the rod is subsequently rotated by the rod-rotator.

2. The apparatus as cited in claim 1 wherein:

the carrier structure comprises a carrier bar; and the length of the sleeve between its top end and its bottom end is substantially equal to the height of the carrier bar.

3. The apparatus as cited in claim 1 wherein the carrier structure comprises a dynamometer which is supported upon a carrier bar; and the length of the sleeve between its top end and its bottom end is substantially equal to the combined height of the dynamometer and the carrier bar.

4. A method for protecting a reciprocating polish rod from circumferential scoring, the polish rod being rotated with a rod-rotator and being suspended by and extending through a bore of a pump jack carrier structure, the carrier structure having a top end for suspending the polish rod and a bottom end through which the polish rod extends, comprising:

providing a cylindrical sleeve having top and bottom ends, the sleeve having an outer dimension adapted to fit the bore of the carrier structure and a bore through which the polish rod passes slidably and rotatably, the top end having an upset;

installing the body of the sleeve into the top of the carrier structure and into its bore, the bottom end of the sleeve extending substantially to the bottom end of the of the carrier structure and the sleeve's upset retaining the sleeve therein;

installing the polish rod through the bore of the sleeve; and suspending the polish rod from the top of the carrier structure so that the sleeve guides the polish rod through the carrier structure without contact of the polish rod and the carrier structure and thereby prevents circumferential scoring of the polish rod when the rod is rotated by the rod-rotator.

5. The method as recited in claim 4 wherein the polish rod is suspended from the carrier structure by securing a rod clamp to the polish rod above the carrier structure.

6. A sleeve fitted to a reciprocating carrier bar of a pump jack, the carrier bar having a polish rod extending therethough and having a top end which supports a rod-rotator, the polish rod being rotatably supported from a rod clamp located above the rod-rotator, the sleeve comprising:

a bore through which a polish rod passes rotatably;

a top end for supporting the rod-rotator and having an upset for retaining the sleeve to the carrier bar; and a bottom end which is spaced from the top end so that it extends substantially through the carrier bar so that the sleeve guides the polish rod through the carrier bar without contact between the polish rod and the carrier bar thereby prevents circumferential scoring therebetween when the polish rod is subsequently rotated by the rod-rotator.

7. The sleeve as recited in claim 6 wherein the length of the sleeve between its top end and its bottom end is substantially equal to the height of the carrier bar.

8. The sleeve as recited in claim 6 wherein:

a dynamometer is located between the rod-rotator and the carrier bar and the sleeve extends through the dynamometer and into the carrier bar; and the length of the sleeve between its top end and its bottom end is substantially equal to the combined height of the dynamometer and the carrier bar.

* * * * *